US006935950B2

(12) United States Patent
Tarantino

(10) Patent No.: US 6,935,950 B2
(45) Date of Patent: Aug. 30, 2005

(54) SLOT-TYPE POKER GAME

(75) Inventor: Elia Rocco Tarantino, Las Vegas, NV (US)

(73) Assignee: Colepat, LLC, North Las Vegas, NV (US)

( * ) Notice: Subject to any disclaimer, the term of this patent is extended or adjusted under 35 U.S.C. 154(b) by 0 days.

(21) Appl. No.: 10/291,145

(22) Filed: Nov. 7, 2002

(65) Prior Publication Data

US 2003/0098544 A1 May 29, 2003

Related U.S. Application Data

(63) Continuation-in-part of application No. 09/620,923, filed on Jul. 21, 2000, now abandoned.

(51) Int. Cl.[7] ..... A63F 1/00

(52) U.S. Cl. ..... 463/20; 273/274; 273/292; 273/138.1

(58) Field of Search ..... 463/20; 273/274, 273/292, 138.1, 139

(56) References Cited

U.S. PATENT DOCUMENTS 4,700,948 A 10/1987 Okada
5,865,437 A 2/1999 Moore, Jr.
6,132,311 A 10/2000 Williams
6,179,711 B1 1/2001 Yoseloff

OTHER PUBLICATIONS

STARDECK, Jun. 20, 1997, 3 pages, http://interstyle.com/stardeck.

Perry, Bill. "STARDECK Playing Cards." Stardeck Games, 1988. 3 pages. http://interstyle.com/stardeck.

*Primary Examiner*—Vishu K Mendiratta
(74) *Attorney, Agent, or Firm*—Weide & Miller, Ltd.

(57) ABSTRACT

A gaming apparatus and a method of playing a game are disclosed. One embodiment of the invention comprises a method including the steps of providing at least sixty-five cards, or card symbols, the cards comprising the standard 52 cards comprising 13 cards of a first, a second, a third and a fourth suit, and 13 additional cards of a fifth suit; presenting at least five of the cards to a player, the cards comprising a hand; and determining if the hand comprises a winning combination of cards. In one embodiment, the method includes the step of presenting the cards on five reels of a gaming machine, each reel containing 13 cards from the five suits. In one embodiment, the cards or other indicia are arranged so that normal poker hand combinations can be received, with each card value (of any suit) appearing only once on a reel.

6 Claims, 3 Drawing Sheets

SLOT-TYPE POKER GAME

RELATED APPLICATION DATA

This application is a continuation-in-part of U.S. application Ser. No. 09/620,923, filed Jul. 21, 2000, now abandoned.

FIELD OF THE INVENTION

The present invention relates to games and gaming devices arranged to present games for play.

BACKGROUND OF THE INVENTION

Poker games are among the most popular to gamblers. The game of poker has a wide variety of variations, but in general, most poker games have the common feature that a winner is determined by a resulting hand comprising the best of five cards.

Poker is commonly played at a table with a shoe comprising one or more decks of cards. The cards are dealt manually to multiple players and/or the house, with each player attempting to win the game by becoming the last remaining player during a betting sequence, or by having the highest ranking poker hand of those players remaining in the game after the betting sequence.

Many gamblers, especially the "casual" gambler, dislike aspects of poker played at a table against other players. Some players find the game of face-to-face poker intimidating. Others do not like the betting aspect of the game, which often involves bluffing. To appeal to these players, gaming manufacturers have developed a variety of video poker machines. These machines have a video screen capable of displaying any of a plurality of cards from one or more standard decks of 52 cards, to a player. In general, after one or more card draws or a selection of the displayed cards, the player attempts to obtain a five card hand which comprises a predetermined winning combination of cards. For example, the machine may be arranged to pay a player winnings on a bet in the event the player receives a pair of Jacks or better. During play, the player attempts to obtain a hand having at least a pair of Jacks or better ranking. In this style of game, the player plays against the house only, and little or no betting strategy is involved.

While video poker is popular, it has a number of drawbacks. First, players like to see more than the five displayed cards (or their replacements). In the case of the video machine, only the displayed cards are visible. Thus, a player is not permitted to see that the next card in the deck might have been a card which they desired. Another aspect of the video poker machine is that it presents a somewhat sterile environment. In general, the more action which is associated with a game, the more likely it will retain a player's interest.

A game which incorporates one or more of the principles of poker and which addresses the above-stated issues is desired.

SUMMARY OF THE INVENTION

The present invention comprises a gaming apparatus and a method of playing a game. More specifically, the invention is a poker type game which may be presented in the format of a slot-type gaming apparatus.

One or more embodiments of the invention comprise a method of playing a game. In one embodiment, the method includes the steps of providing at least sixty-five cards, or card symbols or other indicia. In one embodiment, the cards comprise the standard 52 cards comprising 13 cards of a first, a second, a third and a fourth suit, and 13 additional cards of a fifth suit. The method includes the additional steps of presenting at least five of the cards to a player, the cards comprising a hand; and determining if the hand comprises a winning combination of cards.

In one embodiment, the method includes the step of presenting the cards on five reels of a gaming machine, each reel containing 13 cards from the five suits. In a preferred embodiment, the five suits comprise the four standard suits of hearts, diamonds, clubs and spades, along with an additional fifth suit.

In the preferred embodiment, the cards or other indicia are arranged so that normal poker hand combinations can be received, with each card value (of any suit) appearing only once on a reel. In one such arrangement, the cards of a particular suit associated with a reel are separated by four intermediate values (i.e. are separated by a total value of five or more).

In one embodiment of the method, a player places a bet or wager and then spins the reels. The player is given the opportunity to hold none, one or more, or all of the reels and to spin the non-held reels again. The player is awarded an award in the event the outcome of the second spin is a combination of cards which comprises a predetermined winning combination of cards.

One or more embodiments of the invention comprise a gaming apparatus. In one embodiment, the gaming apparatus includes a plurality of reels on which the cards are displayed. In a preferred embodiment, five reels are provided, each reel having 13 cards associated therewith. The gaming apparatus is arranged to accept a wager from a player and pay winnings in the event a winning combination is received. Hold buttons or other inputs are provided for permitting the player to hold one or more of the reels after a first spin.

In one or more embodiments, the reels are mechanically rotating physical reels, as in a slot-type game. The reels may also be simulated, as in a video format. In one embodiment, the game may be played with 65 or more indicia other than cards or card symbols, the indicia arranged in a specific format.

Further objects, features, and advantages of the present invention over the prior art will become apparent from the detailed description of the drawings which follows, when considered with the attached figures.

DETAILED DESCRIPTION OF THE INVENTION

The invention is a method of playing a game and one or more apparatus for presenting a game for play. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, one aspect of the invention is a slot-type poker game in which at least 65 total cards (or their representations) are utilized. The 65 cards comprise the 52 cards of a single deck of cards comprising the 13 cards of each of the four suits Hearts, Diamonds, Spades and Clubs, along with the 13 cards of an additional, fifth suit. A player attempts to obtain the best hand comprising five of the cards. In a preferred embodiment, the cards are displayed on reels of a slot-type gaming machine or apparatus.

Figure 1:
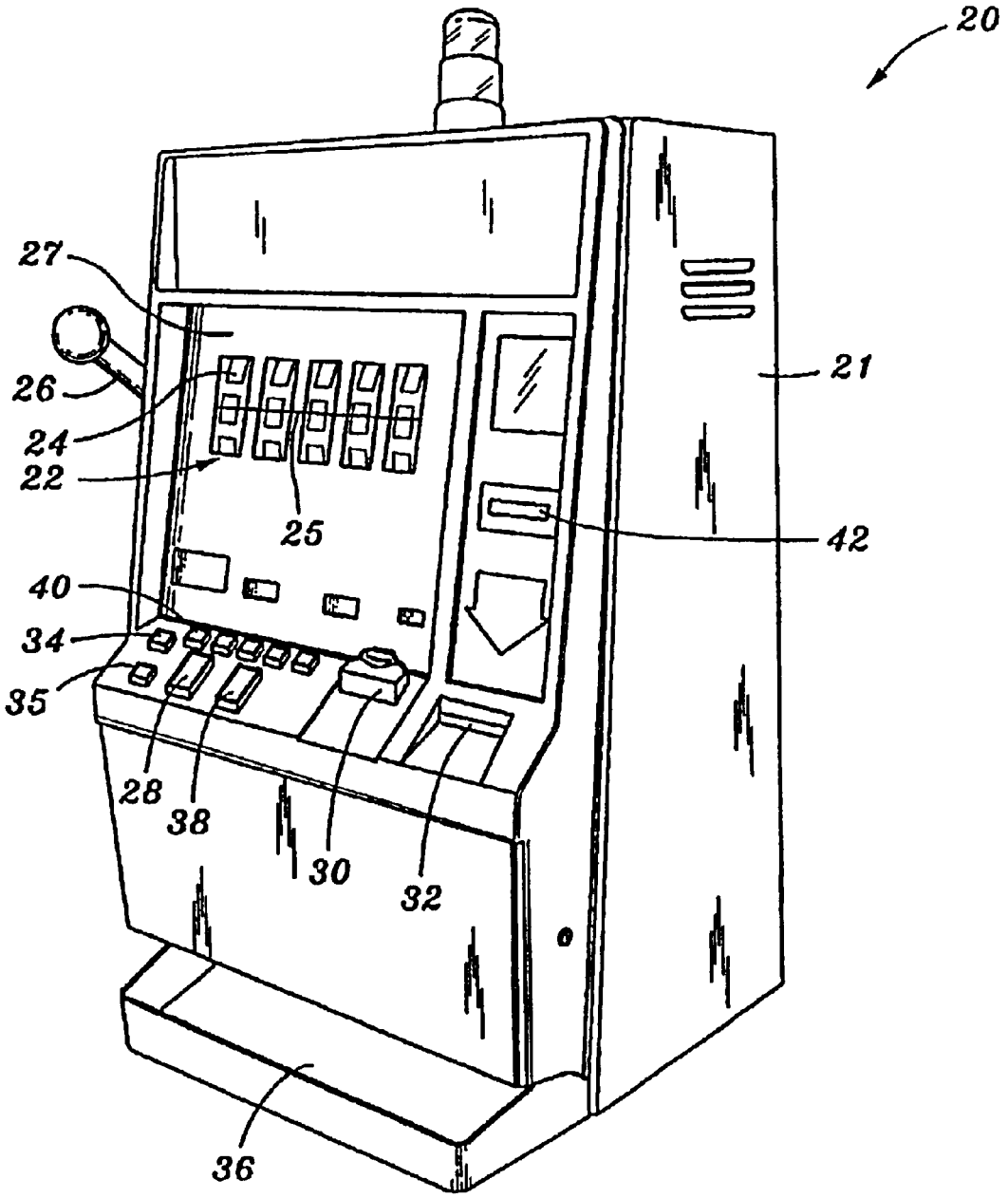
FIG. 1 illustrates a gaming apparatus in accordance with an embodiment of the present invention.

FIG. 1 illustrates a gaming apparatus 20 arranged to present a game in accordance with one embodiment of the invention. It will be understood that a wide variety of devices may be provided for presenting a game in accordance with the present invention. As illustrated, the apparatus 20 includes a cabinet 21 for housing and supporting the systems and apparatus necessary to present the game to a player.

The apparatus 20 includes means for displaying game indicia. In one or more embodiments, this means comprises a plurality of mechanical reels 22. In a preferred embodiment, there are five (5) of these such reels 22.

The reels 22 comprise a body having one or more indicia or symbols 24 printed thereon or otherwise capable of displaying the indicia 24. In one embodiment, the indicia 24 are printed on or affixed to the reels 22. In another embodiment, the indicia 24 may be displayed by or on the reels 22. For example, an image generating device may be arranged to display the indicia 24 on the reels 22, such as by projection (front or rear). In such event, the reels 22 may comprise physical bodies which may or may not rotate, but have the appearance of rotating by the changing display of indicia 24 projected thereon or there through. In this regard, it is noted that the indicia 24 may comprise printed or displayed elements, such as in the form of printed cards or card symbols, as described below.

In one or more embodiments, each reel 22 includes at least thirteen indicia positions or locations. The indicia 24 which are displayed by the reels 22 comprise card symbols. In particular, the indicia 24 include each of the fifty-two (52) cards of a standard deck of cards. As is well known, such a deck of cards comprise the number cards 2 through 10, and the face cards Jack, Queen, King and Ace, in each of the suits Hearts, Diamonds, Spades and Clubs. As referred to herein, the designation two, three, four, five, six, seven, eight, nine, ten, Jack, Queen, King and Ace, of the indicia 24 or card is referred to herein as the "value, " "rank, " or "denomination." As described above, each card or indicia 24 is associated with a particular suit. As is well known, the indication of a particular suit is typically indicated by the following symbols representing a respective suit: ♡ (hearts), ♢ (diamonds), ♢ (clubs), and ♤ (spades).

In addition, in the preferred embodiment of the invention, the indicia 24 includes thirteen (13) additional cards having the values 2–10, Jack, Queen, King and Ace of a fifth or additional suit. This new suit may be represented by a particular symbol. For example, in one embodiment, the new suit is "circles" and is represented by the symbol ♤. The name of the suit and the symbol which is used to identify it may vary, it being understood that the new suit only need be distinguishable from the other four suits.

It will now be appreciated that the indicia 24 which the reels 22 are capable of displaying comprise at least sixty-five (65) indicia 24 comprising thirteen cards of each of five suits. The names of the suits and their designations may vary from those described above and need not include those of a standard deck of cards. For example, the suits might be called circles, squares, triangles, rectangles and ovals and be represented visually by those words or their corresponding geometric shapes. Further, the values of the cards of the suits need not be the same as in a standard deck of cards, but it is preferred that each of the thirteen values be different.

In a preferred embodiment of the game, as described in detail below, the game is played with a single set of the 65 indicia 24. In this manner, during game play no two identical indicia 24 can be received at the same time. Moreover, in accordance with a preferred embodiment of the present invention, the indicia 24 are distributed among the five reels 22 in accordance with particular criteria so that standard poker hands can be presented. In one embodiment, each reel 22 is arranged to display the indicia 24 representing each of the values or denominations two, three, four, five, six, seven, eight, nine, ten, Jack, Queen, King and Ace. In accordance with the invention, however, the indicia 24 representing these values are of differing suits.

Figure 2:
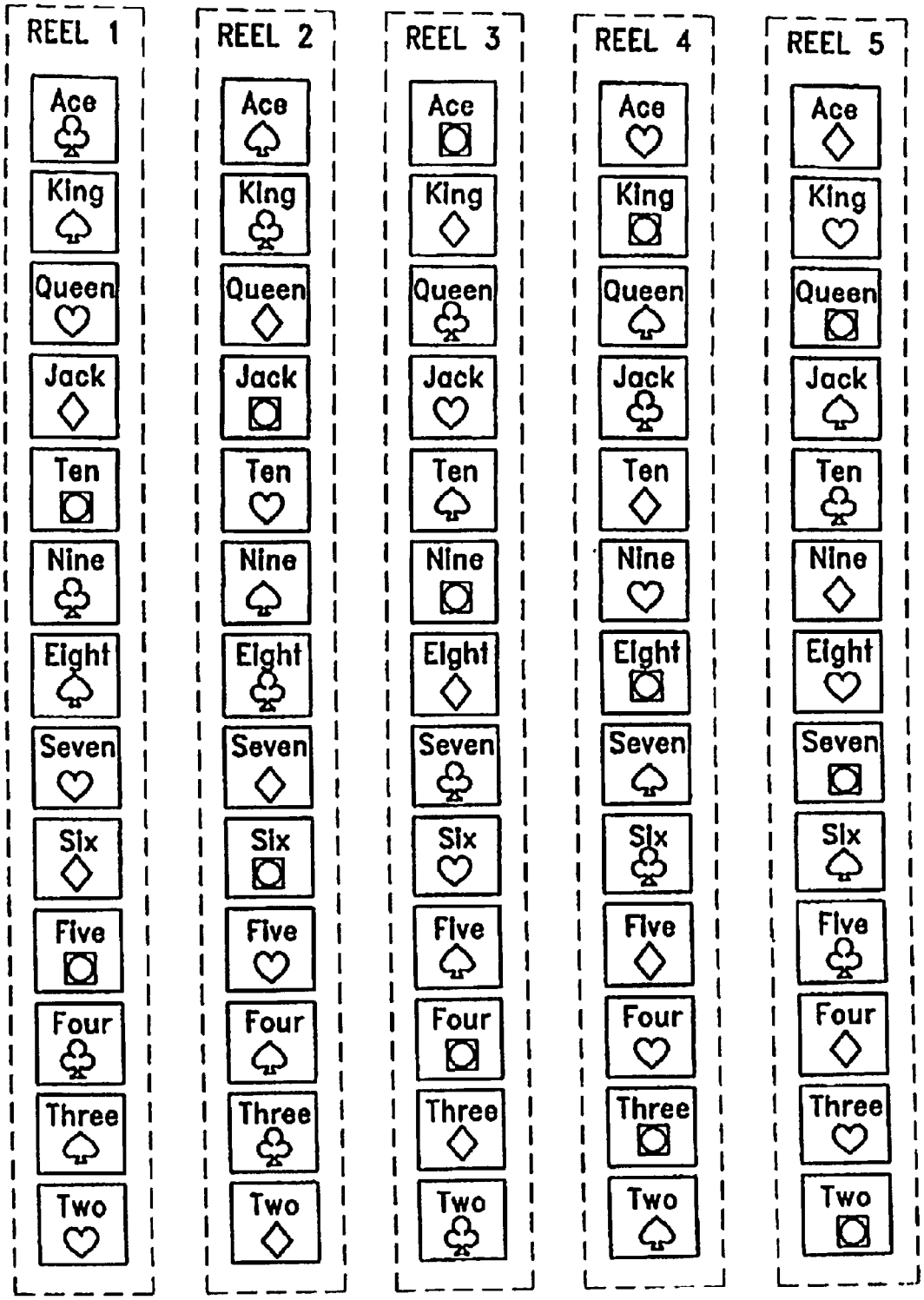
FIG. 2 illustrates one arrangement of indicia for display by each of five reels of the gaming apparatus illustrated in FIG. 1.

In a preferred embodiment, the indicia 24 of a particular suit which are associated with the particular reel 22 are separated by at least four (4) intermediate values or denominations, when considering the above-referenced order or rank (i.e. lowest to highest comprising 2, 3, 4, 5, 6, 7, 8, 9, 10, Jack, Queen, King, and Ace) of the values or denominations. For example, referring to FIG. 2, it will be seen that the third reel 22 includes two indicia 24 of the suit Hearts: the Jack of Hearts and the Six of Hearts. These values are separated by the values 7, 8, 9 and 10. An example of a distribution of indicia 24 for each suit among the five reels 22 is illustrated in FIG. 2. Other arrangements of the indicia 24 may be provided in accordance with the criteria of the invention. However, this particular distribution has the significant advantage that the odds of receiving a card of a particular suit is as linear as possible across the five reels. For example, all cards of a single suit could be placed on a single one of the reels. However, this would prevent a player from ever receiving a flush. The particular distribution of cards of the same suit by at least four (4) intermediate values of five(5)) has the advantage that flushes may be obtained, and the even more significant advantage that straight flushes may be obtained. For example, referring to FIG. 2, it will be seen that the straight flush of 6, 7, 8, 9 and 10 of diamonds may be received. In fact, in the configuration of the invention, every single straight flush which is normally obtainable in the game of poker, with the exception of the Ace low straight (A, 2, 3, 4, 5) can be obtained. Thus, this distribution most closely permits the recreation of table-type poker.

Preferably, one or more combinations of the indicia 24 when displayed as a result of a spin of the reels 22 (as described below) are designated a winning combination of the indicia 24. In a preferred embodiment of the invention, one or more of the predetermined winning combinations of indicia 24 are the same as one or more of the winning hands in the game of poker. Thus, in one embodiment, one or more of the following best combination of 5 indicia 24 "hands" represented by one or more of the indicia 24 displayed by the five reels 22 comprises a winning combination: a pair; three of a kind, two pair, a full house, four of a kind, a straight, a flush, a straight flush, and a royal flush. Such hands are well known in the art of poker games. It is noted that the above described-described criteria for the distribution of the indicia 24 makes possible the receipt or display of such poker hands. It will further be appreciated that in accordance with the present invention, it is possible to obtain a "five of a kind, " i.e. all five reels 22 displaying indicia 24 which comprise the same value or denomination (such as five 7's). This poker hand is not available when using only a standard deck of cards, unless wild cards are utilized.

In accordance with the invention, one or more indicia 24 other than those described above may comprise a predetermined winning combination. For example, in one embodiment, the lowest winning combination may comprise three of a kind instead of a pair. As in the game of video poker, in accordance with the present invention, the lowest "hand" which comprises a winning hand may comprise a pair of Jacks. Other hands may be provided, such as a hand in which one card of each suit is received.

In accordance with an embodiment of the invention, a player is permitted to "hold" one or more of the reels 22 after a first spin and attempt to obtain a better combination of indicia 24 in a second spin in which the non-held reels are rotated. In such an embodiment, one or more hold buttons 40 may be provided for permitting the player to select the one or more reels 22 to be held. In one embodiment, the hold buttons 40 are electromechanical. In another embodiment, the hold buttons may comprise areas of a touch screen display or other apparatus for accepting an input from a player.

Preferably, as described below, a winning or award is provided to a player who receives a predetermined winning combination of indicia 24. Such winnings may be referred to as a "payout" for a particular combination. It will be appreciated that the payout for each particular combination may vary. In one embodiment, the payout for each hand is associated with the odds of a player receiving that combination. For example, the payout for receiving a straight may be much greater than that for receiving two pair. In accordance with the invention, the payout for receiving a winning hand or combination upon the first spin may be larger than for receiving the same hand or combination after a second spin. The particular pay tables and designated winning hands or combinations may vary dependent upon the desired average "hold" of the game to the operator, as is well known. The winning amount that is paid may also vary dependent upon the size of a bet or wager placed by the player.

Means are provided for rotating the reels 22. In one or more embodiments, the means may comprise a mechanical linkage associated with a spin arm 26, with movement of the spin arm (a "pull") by a user causing the reels 22 to spin. In such an arrangement, the reels 22 are generally allowed to free-wheel and then stop.

In another embodiment, electronically controlled mechanisms are arranged to rotate and stop each reel 22. Such mechanisms are well known to those of skill in the art. In this arrangement, actuation of the spin arm 26 or depression of a spin button 28 causes a controller (not shown) to signal the activation of the spin mechanism, such as a stepper motor, associated with one or more of the reels 22. Preferably, the controller is arranged to either turn off the signal to the device(s) effecting the rotation of each or all of the reels 22, or generates a signal for activating a braking device, such as the stepper motor, whereby the reels 22 are stopped. As is well known, the combinations of reel positions and their odds of stopping at the positions thereof are associated with the controller, and the controller is arranged to stop the reels 22 in a position displaying a combination of indicia 24 as determined by the controller based on the combinations and odds. The principal of such an arrangement is described in U.S. Pat. No. 4,448,419 to Telnaes, which is incorporated herein by reference.

In a preferred embodiment, each reel 22 is positioned behind a screening glass or panel 27. The panel 27 includes at least one area through which each of the reels 22, and thus the indicia 24 thereon, may be viewed. In order to aid the player in determining which indicia 24 displayed by the reels 22 comprises the indicia 24 which are evaluated for determining if a winning combination has been received, a pay line 25 is provided. The pay line 25 comprises a line or bar which extends over the reels 22. As illustrated, the pay line 25 comprises a line printed on the screening glass aligned over a central portion of each reel 22. When the reels 22 stop rotating, the indicia 24 on each reel 22 which the pay line 25 extends over or intersects comprise the indicia 24 which are evaluated for determining if a winning combination has been received. Of course, the pay line may be imaginary, and a winning combination determined by the controller or the position of the reels. Preferably, the viewing area and reels 22 are arranged such that a player may see the indicia 24 aligned with the pay line 25, as well as the adjacent indicia 24 of each reel 22. In this manner, a player perceives "how close" they were to other potential combinations of indicia 24.

The gaming apparatus 20 includes a mechanism for accepting a wager or bet. As illustrated, a coin accepting mechanism 30 is provided for accepting coins. A bill acceptor 32 is provided for accepting bills. Other mechanisms may be provided for accepting a wager, such as card or ticket readers or input devices whereby a player may have funds paid from a remote account. A "play credit" 34 button and a "bet max" button 35 may also be provided for permitting a player to place wagers from a pool of credits won or paid by the player. The gaming apparatus 20 may be adapted to accept a variety of coins, such as dimes, quarters or silver dollars. In one or more embodiments, playing a single credit comprises playing an amount of one of the accepted coins, and playing a maximum bet comprises playing or betting an amount comprising a multiple of the value of a single of the accepted coins. In one embodiment, the gaming apparatus 20 may be arranged to accept credits from a credit card, player card, or a remote credit source.

The gaming apparatus 20 includes a means for paying a player winnings. When a player wins a game, the player is preferably paid in the form of stored credits, the amount of which is indicated to the player. A "cash out" button 38 is preferably provided for permitting a player to be paid the winnings or paid in credits. In one embodiment, the means for paying a player comprises a coin dispenser (not shown) for dispensing coins to a coin tray 36. A player may also be permitted to be paid their credits or winnings on a player card in electronic form, such as via a card reader/writer 42.

As described above, the gaming apparatus 20 preferably includes a controller (not shown) for controlling the game, including receiving player input and sending output signals for controlling the various components of the apparatus 20. The controller may be arranged to receive input in the form of a "spin" signal from a spin button or the spin arm 26 (or other spin input), a bet credit signal when the bet credit button 34 is depressed, and a credits insert signal when a player inserts bills or coins. The controller may be arranged to send signals for stopping the reels 22, for causing the coin dispenser to pay winnings, and cause a display to display winning amount information. In addition, the controller is preferably arranged to determine if a spin of the reels 22 has resulted in a win, and if so, the amount to be payed to the player for that win.

As detailed in part above, the number of winning combinations, the odds of receiving a winning combination and the payout for each winning combination may vary, as is well known in the art. If the reels are purely mechanical, the odds of winning are based on the number of indicia 24, the number of reels 22, and the number of predetermined winning combinations. As described above, when a mechanism is employed for stopping the reels 22 in predetermined positions, the controller may be programmed to present desired odds. It will also be appreciated that a player may be paid more for a winning combination when the player places a larger wager. In this regard, the player may be presented with a pay table which indicates the payout for each winning combination based on the wager placed by the player.

The controller may comprise one or more than one element, and may comprise hardware and/or software, such as code executable by a processor. The code may be stored on an appropriate data storage device, such as a hard drive or memory chip, or be integrated into a microprocessor chip. The controller may be part of an integrated system, or be self-contained. The arrangements of such a controller and the principles of odds, payouts and the like are well known to those of skill in the art.

Those of skill in the art will appreciate that the reels 22 may be represented graphically by one or more electronic displays for displaying information such as the indicia 24. For example, in one or more embodiments, an LCD screen may be arranged to display an image comprising all five reels 22 and the indicia 24 associated therewith. In such an arrangement, video data may be generated and sent to a video controller for causing the different images to be displayed by the video screen. The video controller may be arranged to cause the image of a "rotating" mechanical reel to be displayed to simulate rotation of a physical reel.

As described above, a variety of the player input devices or controls comprise physical electromechanical buttons. In place of, or in addition to such controls, one or more touch-screen or touch-sensitive displays may be provided. Such screen(s) may be arranged to display information to a player and accept input from the player. For example, the screen may display a "spin" button area which when touched by the player serves to provide a "spin" signal to the controller.

In one or more embodiments, the winnings paid to a player may comprise other than money. For example, a player may win gifts, such as goods or services. The gaming apparatus 20 may be arranged to print a ticket by which the player redeems their winnings instead of dispensing the winnings directly.

In accordance with one or more embodiments of the invention, the gaming apparatus 20 may be linked to a central computer or comprise a part of a system. In one embodiment, a plurality of the gaming apparatus 20 are associated with a gaming system. The system may include one or more central computers which receive data from the apparatus 20 and which send data to each apparatus 20. In such a system, jackpot bonuses may be awarded, with the jackpot amount relating to the volume of wagers of the linked gaming apparatus 20. For example, a percentage of each wager may be placed into a jackpot which is awarded to a player who receives one or more particular winning combinations of indicia 24, such as a royal flush or a five of a kind.

One or more embodiments of the invention comprise a method of playing a game. In one embodiment, 65 or more indicia 24 are provided. In a preferred embodiment, the indicia 24 comprise the 65 card-type symbols as detailed above. Next, at least five of the indicia 24 are presented to a player. It is then determined if the five indicia 24 comprise a predetermined winning combination.

In one embodiment, the player is permitted to hold one or more of the indicia 24 and is then presented with replacement indicia 24 for the non-held indicia 24. It is thereafter determined if the indicia 24 comprise a winning combination.

Play of a game in accordance with a preferred embodiment of the invention on an apparatus 20 such as that illustrated in FIG. 1 will now be described with reference to such apparatus. Of course, a game played in accordance with the invention may be presented on a wide variety of gaming devices other than that specifically illustrated and described herein, and can also be implemented as a table-type game if desired.

Figure 3:
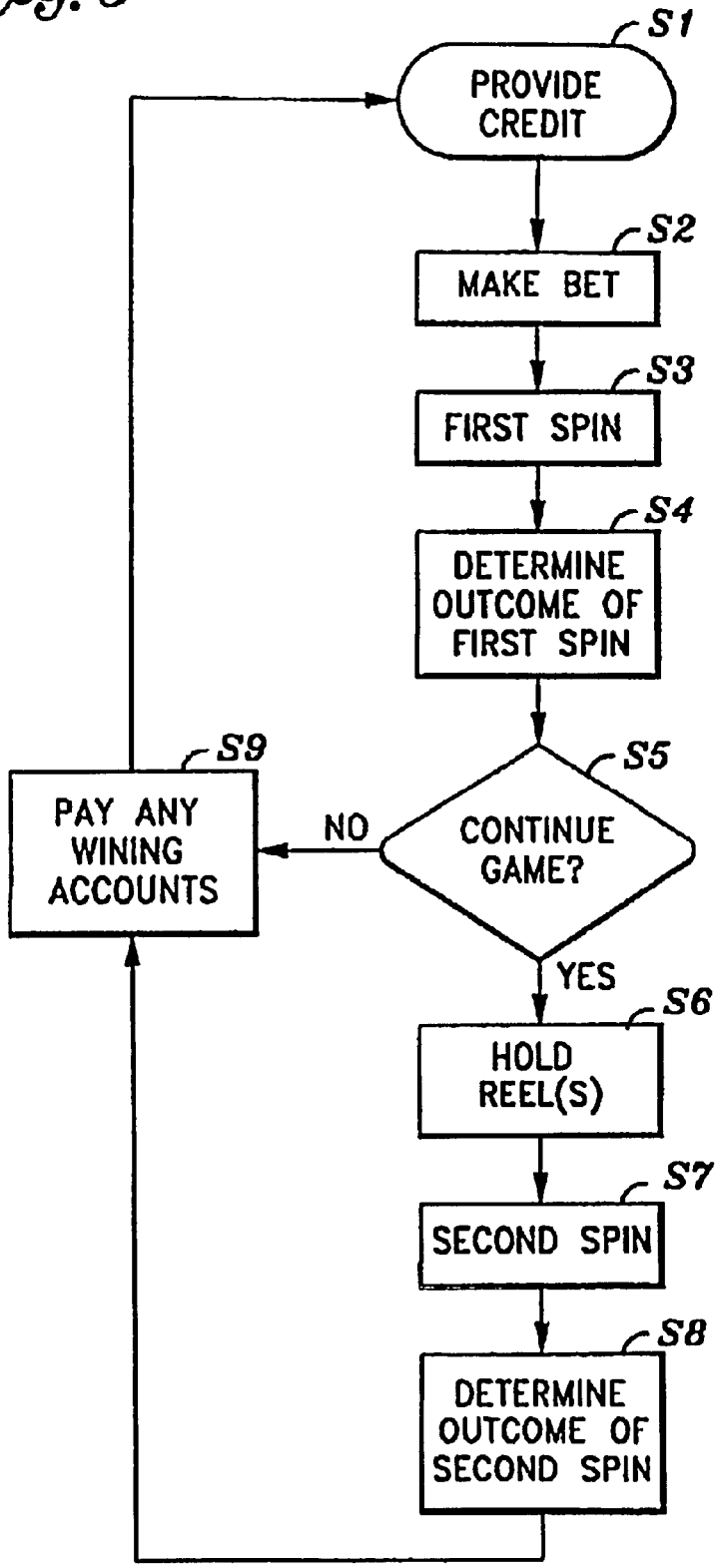
FIG. 3 is a flow diagram illustrating a method of play of a game in accordance with the present invention.

Referring to FIG. 3, in a preferred embodiment of the invention, in a first step S1, a player provides monetary input, such as by inserting coins to the coin acceptor 30, bills to the bill acceptor 32, or the like. Next, in a step S2, the player places a wager or bet. In one or more embodiments, this may be accomplished by the player depressing one or more times the bet credit button 34, or pressing the bet max button 35.

In a step S3, the player is permitted to spin the reels 22. In one embodiment, when the player depresses the "spin" button 28 or pulls the spin arm 26, the reels 22 are caused to spin, as described above. The reels 22 then stop (or are caused to stop), with each reel displaying an indicia 24 associated with the pay line 25. It is noted that the term "spin" as used herein is not limited to actual rotation of the reels. For example, a "spin" may result when a controller is caused to display the reel 22 and indicia 24 associated therewith on a display. In general, the term "spin" simply means a triggering event for causing the indicia 24 to be randomly presented.

In a step S4, it is determined if the main game reels 22 display a winning combination of indicia 24. As described above, such comprises comparing the indicia 24 which are associated with the pay line 25 with predetermined winning combinations of indicia 24.

In a step S5 it is determined if the player wishes to end the game or continue. If the player wishes to end the game, then in a step S9 the player is paid any winnings for achieving a winning combination as determined in step S4. On the other hand, the player may elect to continue the game and proceed to a step S6. In general, a player is likely to only terminate the game at step S5 in the event the player has already received a winning combination of indicia 24. In such event, the player may elect to be paid those winnings, not risking the winning hand. In one embodiment, the player may be permitted to stop the game after the first spin by depressing the cash-out button 38.

In step S6, the player is permitted to hold one or more of the reels 22. In one embodiment, the player depresses one or more of the buttons 40, each depressed button 40 effective in holding one of the reels 22. In one or more embodiments, the player may elect to hold none, one or more, of all of the reels 22. It will be appreciated that if all of the reels 22 are held, then in a subsequent second spin, the indicia 24 displayed by the reels 22 will not change, nor will the outcome of the game. In this respect, step S5 may be eliminated in one embodiment by permitting a player to simply hold all of the reels 22 in the event the player wishes to retain the outcome of the first spin.

After the player has elected which reels 22, if any, to hold, in a step S7 the player spins the non-held reel(s) 22. In one embodiment, after the player elects which reels 22 to hold, the player depresses the spin button 28 or the pulls the arm 26. Each reel 22 which was not held is then spun. After the spin, an indicia 24 from each reel 22 is associated with the payline 25.

In a step S8, it is determined if the combination of indicia 24 displayed after the second spin comprises a predetermined winning combination of indicia. In step S9, any winnings are paid to the player. Of course, if the player did not receive a winning combination of indicia 24 after the second spin, then the player is not a winner and the game is concluded. If the player received a winning combination, then the winning associated with the particular combination is awarded to the player.

After the game is concluded, including the award of any winnings, the player may begin a new game as described above.

As described above, the term "spin" is not limited to the physical rotation of the reel 22. For example, in the event the indicia 24 are displayed on a video display, the act of spinning comprises displaying indicia 24. In a preferred embodiment, the indicia 24 which are displayed are randomly selected and then displayed, as is well known in the art of video slot machines. Further, the act of "holding" the reels 22 may not comprise the physical stoppage of a mechanical reel, as in the case the indicia 24 are displayed by a video display. In such event, the act of "holding" comprises maintaining particular displayed information.

As described above, the predetermined winning combinations for which a winning may be awarded may comprise a wide variety of one or more of the indicia 24, including one or more of the combinations which are well known in the art of poker games. In accordance with the invention, the hand of five of a kind is available for award, a combination which is not available in a table game of poker using a 52 card deck unless wildcards are permitted.

In one or more embodiments of the invention, the game involves only a single spin of the indicia 24, and no subsequent hold and re-spin is permitted. In another embodiment, more than two spins (and, if desired, holds) are permitted.

In one or more versions of the game, wild cards may be permitted. In one embodiment, the wild cards may comprise one of the cards or indicia 24 selected from the group described above. For example, "2s" may be declared wild cards, such as a player receiving the indicia 24 combination 8, 8, 8, 2, 8 is declared as the recipient of a "5 of a Kind" hand, with the 2 taking the value of an 8. In another embodiment, wild cards may be added to the group of indicia 24. For example, the total number of indicia 24 may be 70, including the 65 indicia 24 described above and five wild cards. In the case of a game in which 5 reels are utilized, a single wildcard may be associated with each reel 22. In such event, combinations including the wildcards or all of the wildcards as winning combinations may be permitted. Of course, a wide variety of other combinations of indicia 24 may be provided.

One or more embodiments of the game may be played in a table-game format. In such event, the indicia 24 may be presented on cards, tokens or the like. The act of spinning may then be replaced by the act of dealing the cads, tokens or the like. A player may hold one or more of the cards and receive replacements in a second deal. In another embodiment, the game may be presented entirely on a video device.

In one or more embodiments of the invention, more than five of the indicia 24 may be presented to a player. In such event it is still preferred, but not necessary, that the determination of a win be based on the best combination of five indicia 24. In a preferred embodiment of the invention where the game is presented for play on a reel-type slot machine, it is desirable that only 5 reels 22 be provided and thus 5 indicia 24 be in play at a given time, to preserve the special arrangement of indicia 24 described above (i.e. 13 indicia per reel 22 such that the standard poker hands are available).

Several aspects of the game of the present invention will now be appreciated. In accordance with the invention, a slot-type gaming machine is provided which presents to a player a game of "five card" poker. In this regard, the invention offers players the same excitement as a game of poker. In addition, however, the game may be played by a player on a machine, such that the player does not have to play against other players at a table. The game offers the players the ability to control betting and speed of play, without "bluffing" and similar sometimes undesirable aspects of the table game. Because the player can control the speed of play, the level of excitement to a player is raised. A player does not need to sit at a table and wait for long periods of time for other players to make elections of bets and additional cards.

A particular advantage of the invention, in one embodiment, is the use of an entire deck of cards plus an additional suit of cards. This arrangement, coupled with a particular distribution of the indicia 24, solves a long existing problem of how to present a poker-type game on a slot machine. Other attempts at a slot-type poker game have been made, but have resulted in other than standard five card hands, less than the normal combinations, use of duplicate cards and the like. In accordance with the invention, all poker hands available when playing table-poker with a 52 card deck are available except a low-straight (A, 2, 3, 4, 5). This is offset by the availability to obtain a special "5 of a kind" hand.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of playing a game comprising the steps of:

accepting a wager;

spinning five reels, each reel configured to display indicia comprising the card values 2, 3, 4, 5, 6, 7, 8, 9, 10, Jack, Queen, King and Ace, said indicia including a card suit selected from five different suits, with card values of the same suit separated by a value of 5;

displaying five indicia comprising the result of the spin of said five reels; and determining if the five indicia comprise a predetermined winning poker hand.

2. The method in accordance with claim 1 wherein said spinning step comprises rotating mechanical reels having said indicia printed thereon.

3. The method in accordance with claim 1 wherein said reels are video generated.

4. A gaming machine comprising:

a wager accepting device;

a plurality of reels bearing indicia comprising the card values 2, 3, 4, 5, 6, 7, 8, 9, 10, Jack, Queen, King and Ace, said card values associated with one of five different suits, said card values of the same suit on a particular reel separated by a value of 5; means for rotating said reels in response to a wager accepted by said wager accepting device and a spin input by a player; and means for determining the outcome of a game represented by five indicia displayed by said reels.

5. The gaming machine in accordance with claim 4 including a spin input device.

6. The gaming machine in accordance with claim 4 including means for paying a player a winning amount if said outcome of said game is a winning outcome.

* * * * *

UNITED STATES PATENT AND TRADEMARK OFFICE

CERTIFICATE OF CORRECTION

PATENT NO. : 6,935,950 B2
DATED : August 30, 2005
INVENTOR(S) : Elia Rocco Tarantino It is certified that error appears in the above-identified patent and that said Letters Patent is hereby corrected as shown below:

Column 3,
Line 53, delete "♦ (clubs), and ♣ (spades)" and insert in its place -- ♣ (clubs), and ♠ (spades) --.
Line 59, delete "symbol ♠" and insert in its place -- symbol ◙ --.

Column 4,
Line 41, insert -- (i.e. by a total value -- before the text "of five (5))".

Signed and Sealed this

Twenty-ninth Day of November, 2005

JON W. DUDAS
*Director of the United States Patent and Trademark Office*